US005749787A

United States Patent [19]

Jank

[11] Patent Number: 5,749,787

[45] Date of Patent: May 12, 1998

[54] FLOOR COVER, ESPECIALLY SPORTS FIELD COVER

[75] Inventor: Werner A. Jank, Sonnhaldenstrasse 8, CH-6052 Hergiswil, Switzerland

[73] Assignee: Werner A. Jank, Hergiswil, Switzerland

[21] Appl. No.: 530,135

[22] PCT Filed: Jan. 12, 1995

[86] PCT No.: PCT/CH95/00008

§ 371 Date: Nov. 7, 1995

§ 102(e) Date: Nov. 7, 1995

[87] PCT Pub. No.: WO95/19822

PCT Pub. Date: Jul. 27, 1995

[30] Foreign Application Priority Data

Jan. 19, 1994 [CH] Switzerland ..... 165/94

[51] Int. Cl.[6] ..... A63C 19/10

[52] U.S. Cl. ..... 472/92; 404/32

[58] Field of Search ..... 472/92, 94, 90; 404/32, 33, 18, 70; 52/177; 428/120, 133, 137

[56] References Cited

U.S. PATENT DOCUMENTS

| | | | |
|---|---|---|---|
| 1,628,090 | 5/1927 | Weiss | 404/32 X |
| 3,022,712 | 2/1962 | Cousino et al. | 472/92 |
| 4,301,207 | 11/1981 | Schomerus | 472/92 X |
| 4,948,116 | 8/1990 | Vaux | 472/92 |
| 5,123,778 | 6/1992 | Bohnhoff | 404/32 X |

*Primary Examiner*—Kien T. Nguyen
*Attorney, Agent, or Firm*—McGlew & Tuttle

[57] ABSTRACT

A floor covering, in particular for sport fields, based on elastic plastics, has a substantially flat top side on which one can walk and a bottom side spaced apart therefrom. The covering has an anisotropic elasticity in the desired running direction, so that it dampens more strongly the impact of a shoe of a runner running on the top side in the desired direction than the impact of the shoe of a runner running on the top side in the opposite direction.

18 Claims, 4 Drawing Sheets

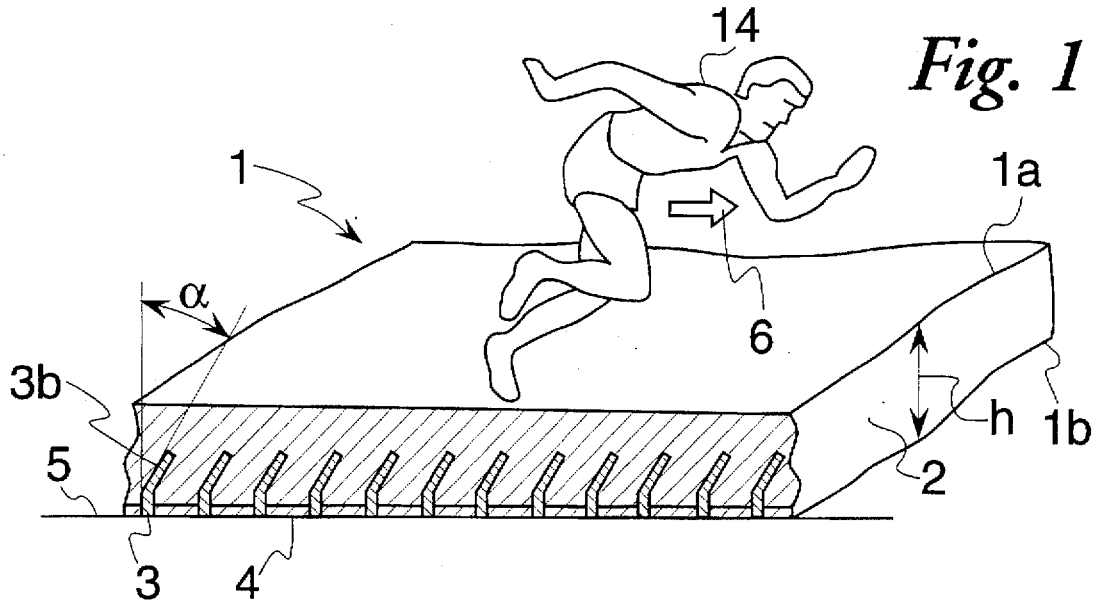
Fig. 1
Fig. 2
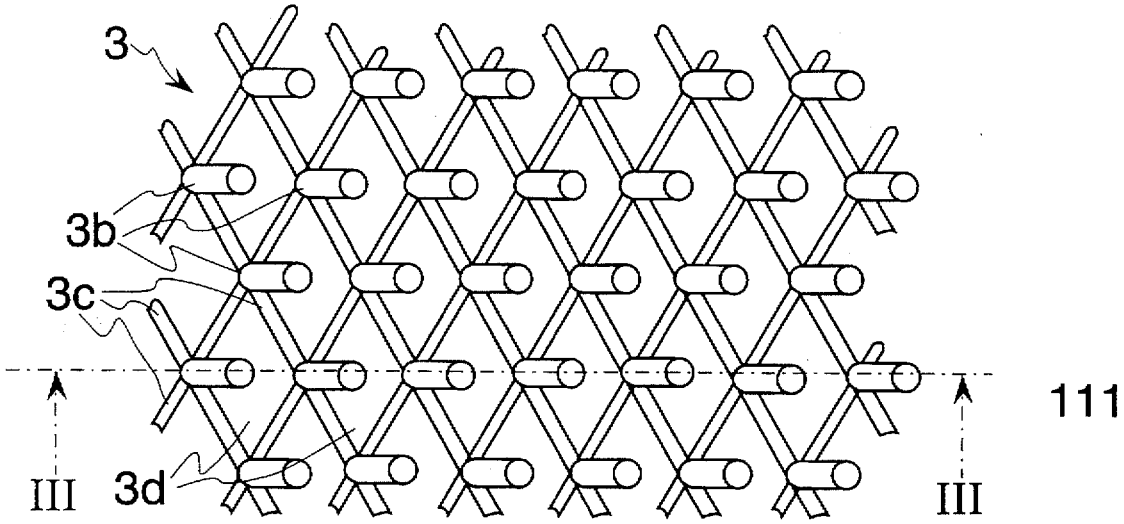
Fig. 3
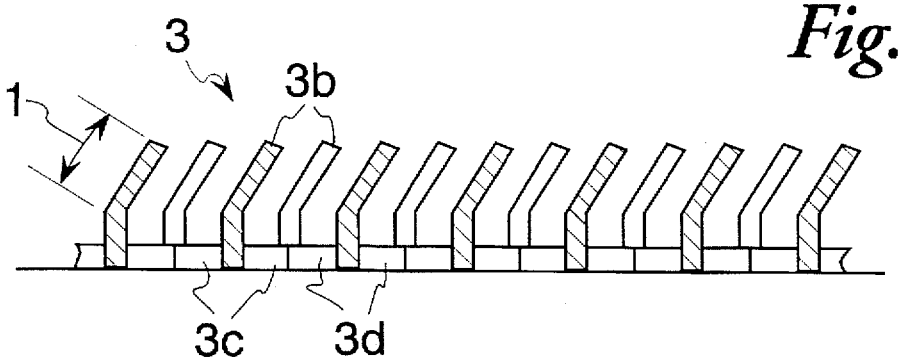

FLOOR COVER, ESPECIALLY SPORTS FIELD COVER

FIELD OF THE INVENTION

The present invention pertains to a floor cover based on an elastic plastic, with an essentially flat and passable top side and an underside arranged at a spaced location therefrom.

BACKGROUND OF THE INVENTION

Such covers for sports facilities have been known as granular covers, solid plastic covers or so-called sandwich covers. Such covers contain elastic plastic particles, which are bound with an elastic plastic resin binder. Waste rubber particles or the like are usually added, especially for cost reasons.

The covers are especially suitable for running sports, because they have a damping action during running as a consequence of their elasticity and diminish the overloading especially of joints. The surface is uneven as a consequence of projecting synthetic resin particles, and it ensures good adhesion of the running shoes when pushing off. Excellent running times have therefore been reached on such covers in short-and medium-distance events.

SUMMARY AND OBJECT OF THE INVENTION

The object of the present invention is to provide a floor cover which promotes even shorter running times and is yet durable and can be manufactured at a low cost. The task is accomplished in a floor cover of this class by the floor cover having means for forming anisotropic elasticity in the intended direction of running which is substantially parallel to the floor, or moving such that it damps a running shoe acting on the top side approximately in the direction of running more strongly than a running shoe acting on the top side in the opposite direction.

It is possible due to direction-dependent damping properties to design a sports field cover which is substantially harder to the runner at the time of pushing off, than during the deceleration after the airborne phase. This makes possible a better propulsion with equal damping actions at the end of the airborne phase. The floor cover according to the present invention is also suitable for use as a support surface for moving objects such as an industrial floor cover, e.g., for ramps and escalators, as well as for walkways especially where elasticity in one direction is preferred to another direction.

The present invention can be embodied at a particularly low cost if an elastically anisotropic means such as a material such as netting or fabric, which has a lower elasticity than the elastic plastic at least in some areas, is inserted into the elastic plastic, and this netting or fabric has pins, pegs or the like, which are inclined in the direction of running. In the case of a force acting on the top side of the cover approximately in the direction of running, these pins or pegs are bent at right angles to their longitudinal direction, and they exert only a very weak counterforce as a result. In the case of a corresponding action of a force in the opposite direction, these pins or pegs are stressed in their longitudinal direction, and as a result they offer a substantially stronger counteracting resistance to a deformation. The runner correspondingly experiences a higher resistance and correspondingly a weaker damping in this direction. Such a fabric is preferably made of synthetic or natural rubber. The elastic plastic forming the base is now preferably an elastomer, e.g., polyurethane.

The floor cover according to the present invention may be prepared from prefabricated slabs or webs or directly by pouring, especially on a sports field. The netting or the fabric can thus be fastened to the flat base prepared by means such as an adhesive. For example, polyurethane is subsequently poured on until the pins or pegs are covered.

The various features of novelty which characterize the invention are pointed out with particularity in the claims annexed to and forming a part of this disclosure for a better understanding of the invention, its operating advantages and specific objects attained by its uses, reference is made to the accompanying drawings and descriptive matter in which preferred embodiments of the invention are illustrated.

FIG. 1 is a view of a sports field cover according to the present invention, FIG. 2 is a top view of a detail of a netting, FIG. 3 is a section through the netting along line III—III in FIG. 2, FIGS. 4 through 6 show the preparation of a sports field cover, FIG. 7 shows schematically the deformation of the sports field cover during deceleration, FIG. 8 shows schematically the deformation of the cover at the time of pushing off, FIG 9. is a detail of a variant or different embodiments of a sports field cover, and FIGS. 10 and 11 are details of other variants or different embodiments of sports field covers according to the present invention.

DETAILED DESCRIPTION OF THE PREFERRED EMBODIMENT

Figure 4:
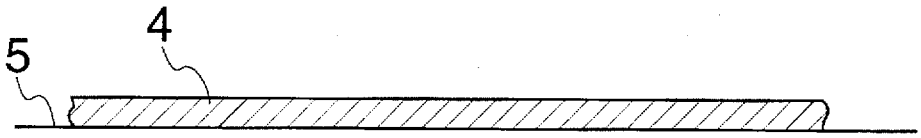

Referring to the drawings, FIG. 1 shows a cover 1 with a top side 1*a* and an essentially parallel underside 1*b*, which is parallel thereto. The direction of running is indicated by the arrow 6 and is illustrated by a runner 14, who is represented on an essentially smaller scale than the cover 1 for reasons of representation. The cover 1 rests on a flat base 5, which may be any base. The cover 1 may consist of individual slabs or webs or be prepared by one pouring operation.

Figure 10:
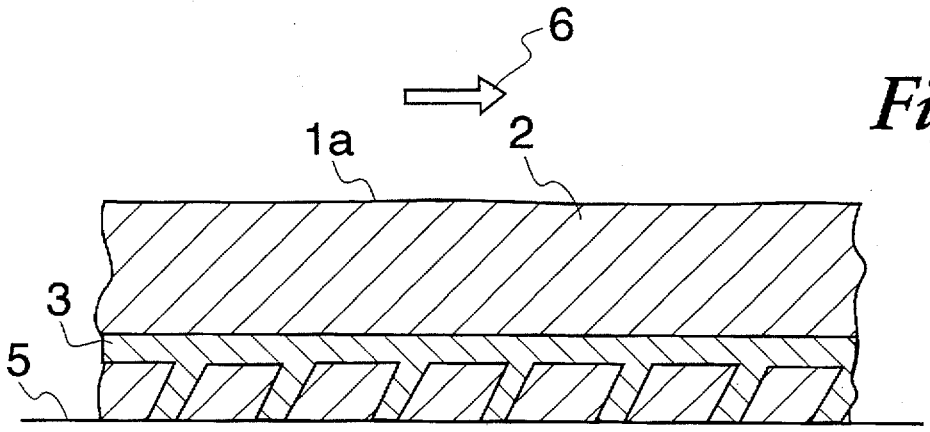
Figure 11:
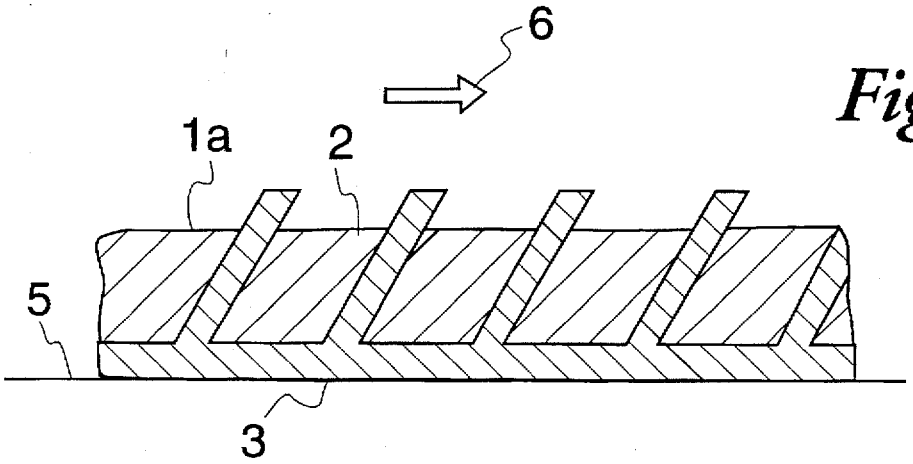

The distance h between the top side 1*a* and the underside 1*b* is usually in a range of 0.5 to 3 cm, and it is preferably about 1 cm. The cover 1 comprises essentially an adhesive layer 4, a layer 2 consisting of an elastic plastic, e.g., polyurethane, as well as an elastically anisotropic means such as a netting 3 consisting of synthetic or natural rubber. The netting is embedded in the layer 2. The elasticity of the layer 2 is greater and preferably substantially or significantly greater than that of the netting 3. The netting 3 is shown in greater detail in FIGS. 2 and 3. As can be seen, it has a plurality of pins or pegs 3*b*, which are inclined in the same direction at an angle Â or to the vertical. This angle Â is, e.g., 30°, but essential deviations therefrom are possible. The length 1 (FIG. 3) of the pins or pegs 3*b* is, e.g., 11 mm. They may project at the top according to FIG. 11. The pins or pegs 3*b* are connected to one another by webs 3*c*. Between the webs 3*c*, the netting 3 has openings, which are filled with adhesive 4. The netting 3 is thus fixed by the adhesive 4 as well as by the elastic plastic 2. Designs in which the pins or pegs 3*b* are directed downward, according to FIG. 10, rather than upward, are conceivable as well. The inclinations of the pins or pegs 3*b* in the floor cover may differ depending on the actual requirements. It is advantageous, e.g., in the case of a floor cover for a high jump facility, to make the pins or pegs 3*b* steeper in the take-off area than in the rest of the area.

Figure 5:
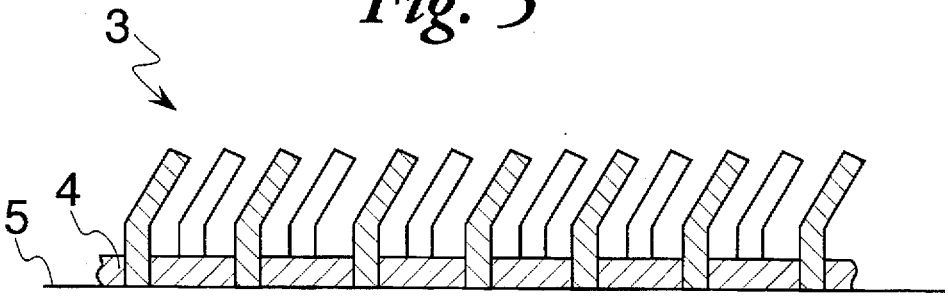
Figure 6:
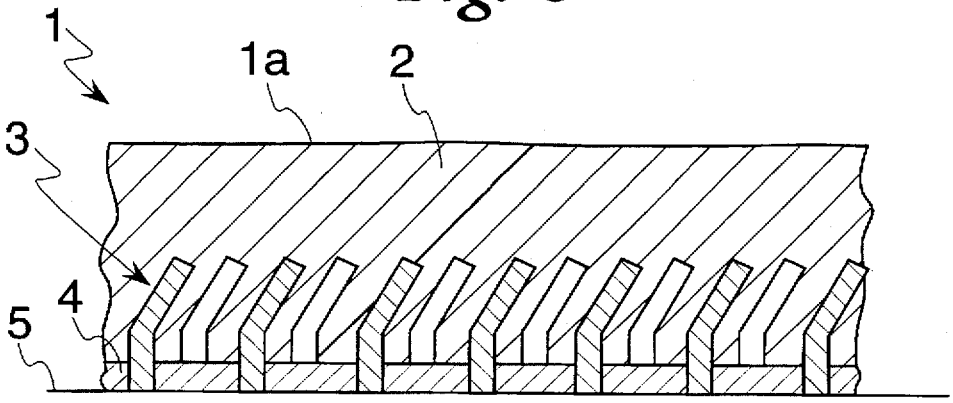

FIGS. 4 through 6 schematically show the preparation of the cover according to FIG. 1. After preparation of the base 5, a uniform layer 4 of a suitable adhesive is applied to it. The netting 3 is placed on the layer 4, so that the adhesive of the layer 4 flows into the openings 3*d* and the netting 3 is fixed on the base 5. To form the layer 2, a suitable elastic plastic, preferably polyurethane, is subsequently poured over the fixed netting 3, and distributed. After curing of the layer 2, the pins or pegs 3*b* are fixed in the layer 2 as shown in FIG. 6, and they are connected thereto. The preparation may be carried out directly on the sports facility in a relatively simple manner, or individual slabs or carpet-like covers may be prefabricated.

Figure 7:
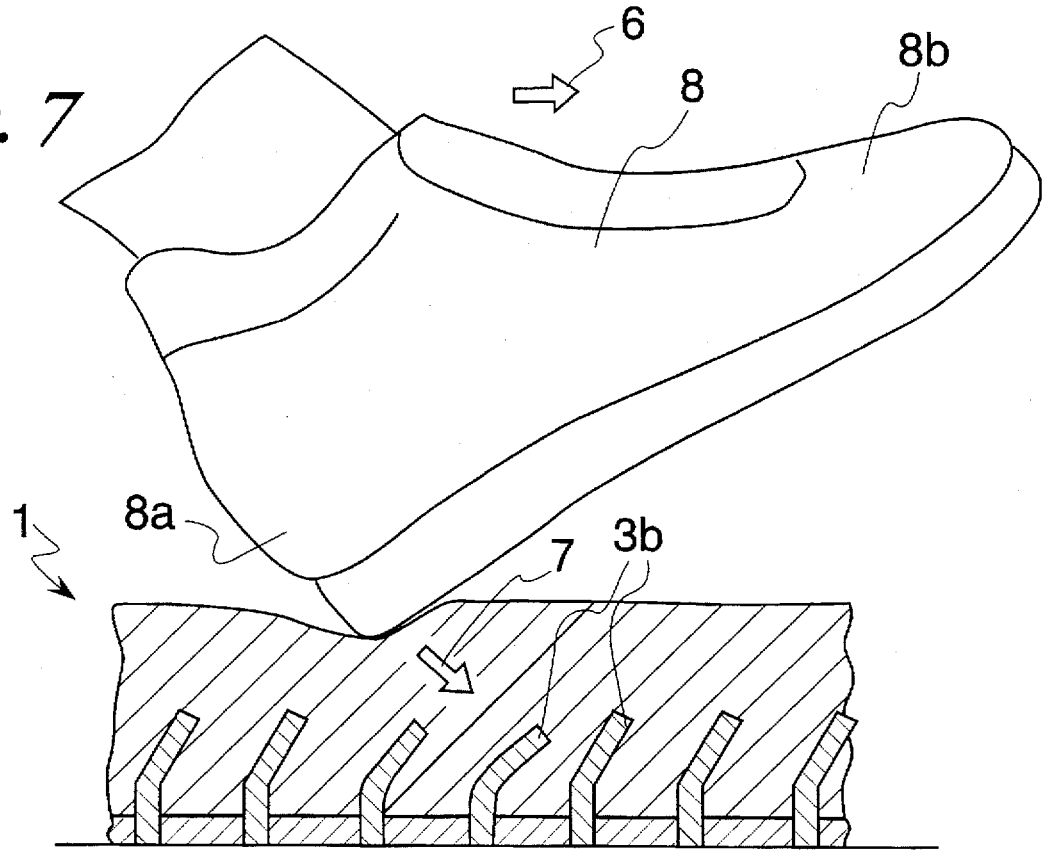
Figure 8:
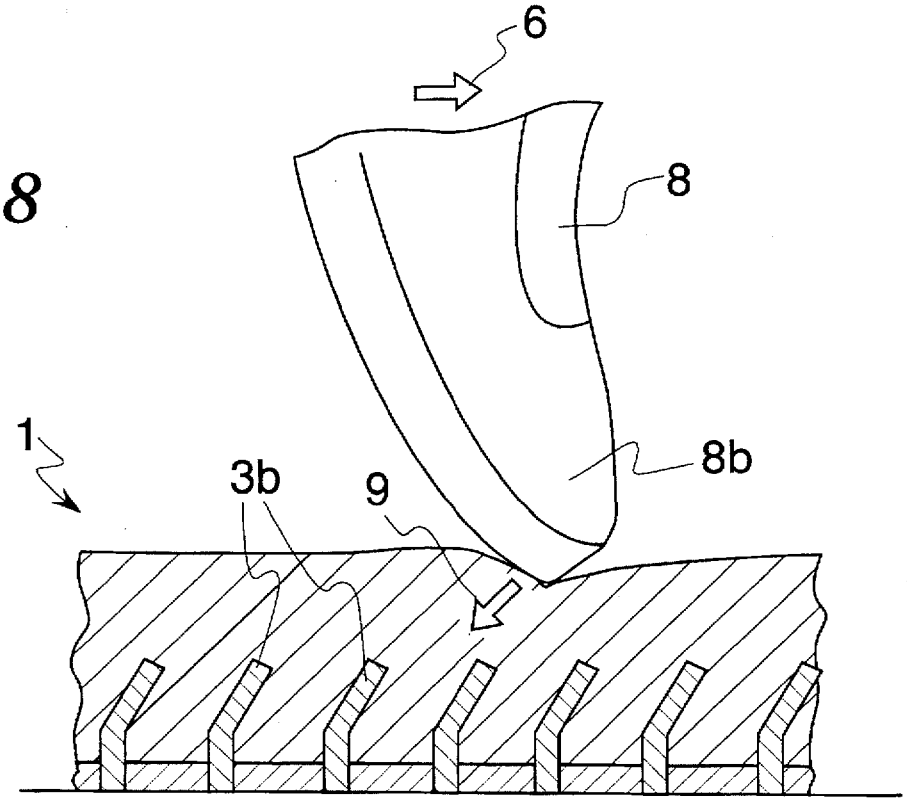
Figure 9:
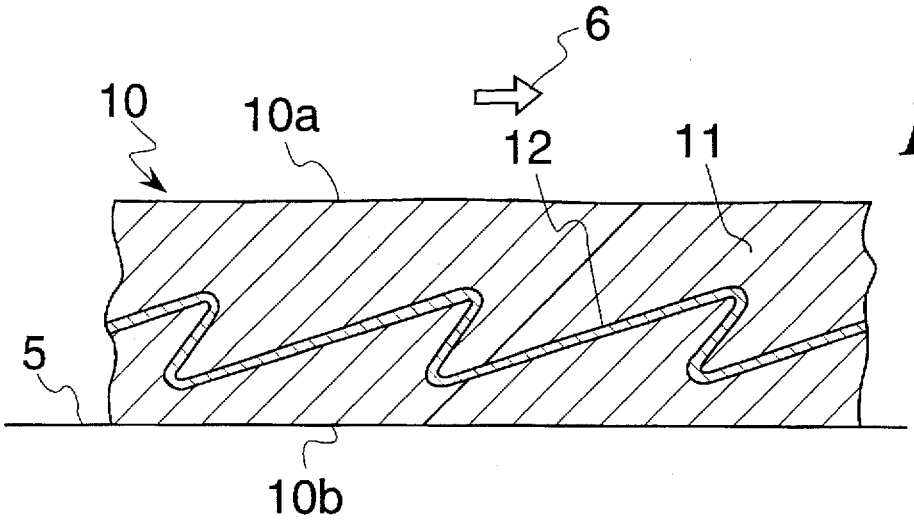

FIGS. 7 and 8 illustrate the action of the cover for sports facilities according to the present invention. FIG. 7 shows a foot 8 of the runner 14, who is landing with the heel 8*a* on the top side 1*a* of the cover 1 in the direction of arrow 7 at the end of the airborne phase. The cover 1 is deformed by the force acting on the cover 1, and the pins or pegs 3*b* are bent more or less intensely. Since the pins or pegs 3*b* do not offer an essential resistance here, the impact of the foot 8 is damped, and the cover 1 is thus elastic in the direction of arrow 7. At the time of the pushing off, i.e., at the beginning of a new airborne phase, the foot 8 exerts a force acting in the rearward direction in the toe area 8*b*, as is shown in FIG. 1. The pins or pegs 3*b* are loaded in their longitudinal direction by the pushing-off force. However, the pins or pegs 3*b* can yield only little in this, so that they are hard during the pushing off according to FIG. 8, thus substantially reducing the damping properties of the cover 1 in this direction. Thus, the pushing off can take place against a cover that is substantially less elastic in this direction, and it is correspondingly more effective for the movement It is clear to the person skilled in the art that the anisotropy of the cover 1, which is essential for the present invention, can be achieved in different ways. FIG. 9 shows, e.g., a design in which a finished fabric 12, which has a wavy pattern in the direction of running 6, as is shown here, is embedded in an elastic plastic 11. The fabric 12 may be a synthetic fabric, e.g., a polyester fabric.

While specific embodiments of the invention have been shown and described in detail to illustrate the application of the principles of the invention, it will be understood that the invention may be embodied otherwise without departing from such principles.

I claim:

1. A support covering for supporting objects, the support surface comprising:

a material positionable on a base and having a surface contactable with the objects to provide support to the objects, said material having elasticity, said material having elastically anisotropic means for being anisotropic with respect to said elasticity in directions substantially parallel to said surface.

2. A support covering in accordance with claim 1, wherein:

said material is designed to supports support moving objects, and said elastically anisotropic means being further designed to be elastically anisotropic with respect to a moving direction of the moving objects, said moving direction being substantially parallel to said surface.

3. A support covering in accordance with claim 2, wherein:

a magnitude of said elasticity is greater in said moving direction than in a direction opposite said moving direction.

4. A support covering in accordance with claim 3, wherein:

said moving direction is direction in which an object supported by the support covering moves.

5. A support covering in accordance with claim 2, wherein:

said material includes a first component as said elastically anisotropic means and a second component, said first component being embedded in said second component, said first component having a lower elasticity than said second component in said moving direction and being elastically anisotropic with respect to said moving direction.

6. A support covering in accordance with claim 5, wherein:

said first component includes a plurality of projections inclined towards said moving direction.

7. A support covering in accordance with claim 6, wherein:

said projections are inclined in a range of 10 to 80 degrees with respect to a normal to said surface.

8. A support covering in accordance with claim 6, wherein:

said projections are inclined in a range of 20 to 40 degrees with respect to a normal to said surface.

9. A support covering in accordance with claim 5, wherein:

said first component includes one of a netting and fabric extending over substantially an entire area of the support.

10. A support covering in accordance with claim 5, wherein:

said first component is one of synthetic or natural rubber.

11. A support covering in accordance with claim 5, wherein:

said second component is an elastic plastic.

12. A support covering in accordance with claim 5, wherein:

said second component is an elastomer.

13. A support covering in accordance with claim 5, wherein:

said second component is polyurethane.

14. A support covering in accordance with claim 1, wherein:

said material supports is designed to support athletic running, and said elastically anisotropic means for being further designed to be elastically anisotropic with respect to a running direction of said athlete running.

15. A support covering in accordance with claim 14, wherein:

said elastically anisotropic means dampens impacts to said surface from a running shoe less in said running direction than in a direction substantially opposite to said running direction.

16. A support covering in accordance with claim 1, wherein:

said material supports moving objects generating force in an acceleration direction and dissipates force in a substantially opposite deceleration direction, said elastically anisotropic means is more elastic in said deceleration direction than said acceleration direction.

17. A running surface comprising:

a base for supporting running in a predominate direction;

a material positionable on said base and having a exterior contactable with running shoes, said material having elastically anisotropic means being elastically anisotropic with respect to said predominate direction.

18. A support covering in accordance with claim 17, wherein:

a magnitude of said elasticity is greater in said predominate direction opposite said predominate direction.

* * * * *